US005605790A

United States Patent [19]

Nimura et al.

[11] Patent Number: 5,605,790

[45] Date of Patent: Feb. 25, 1997

[54] METHOD OF PRODUCING A SILVER HALIDE PHOTOGRAPHIC EMULSION

[75] Inventors: Yumiko Nimura; Chikao Mamiya; Haruhiko Masutomi; Kazuyoshi Ichikawa, all of Hino, Japan

[73] Assignee: Konica Corporation, Japan

[21] Appl. No.: 569,654

[22] Filed: Dec. 8, 1995

[30] Foreign Application Priority Data

Dec. 14, 1994 [JP] Japan ..... 6-310769

[51] Int. Cl.[6] ..... G03C 1/015; G03C 11/06

[52] U.S. Cl. ..... 430/569

[58] Field of Search ..... 430/569

[56] References Cited

U.S. PATENT DOCUMENTS 5,169,750 12/1992 Vacca ..... 430/569

5,202,226 4/1993 Saitou ..... 430/569

5,254,454 10/1993 Mimiya et al. ..... 430/569

*Primary Examiner*—Mark F. Huff

*Attorney, Agent, or Firm*—Jordan B. Bierman; Bierman and Muserlian

[57] ABSTRACT

Disclosed is a method of producing a silver halide photographic emulsion comprising steps of:

(a) forming fine-grain silver halide emulsion in a mixing vessel B separately provided from a reaction vessel A, (b) removing unnecessary ions contained in said fine-grain silver halide emulsion, (c) supplying the fine-grain silver halide emulsion to said reaction vessel A, (d) forming nucleation of a silver halide grain in said reaction vessel A, and (e) forming crystal growth of the silver halide grain in said reaction vessel A.

8 Claims, 5 Drawing Sheets

CEM : CATION-EXCHANGE MEMBRANE
AEM : ANION-EXCHANGE MEMBRANE
P : PUMP

METHOD OF PRODUCING A SILVER HALIDE PHOTOGRAPHIC EMULSION

FIELD OF THE INVENTION

The present invention relates to a method of producing a silver halide photographic emulsion, and more particularly to a method of producing a silver halide photographic emulsion composed of silver halide grains wherein unevenness of silver halide grains is eliminated and efficiency of spectral sensitization and chemical sensitivity is improved, and to a silver halide photographic light-sensitive material using the same.

BACKGROUND OF THE INVENTION

Heretofore, in a method of producing the silver halide photographic emulsion, silver halide grains are formed by reacting an aqueous silver salt solution and an aqueous halogen salt solution in a reacting vessel, and then, from among excessive halogenated substances which remained in the system, unnecessary substances such as potassium ions, sodium ions, nitric acid ions and ammonia are removed by means of washing so that the silver halide photographic emulsion is obtained.

When the density of salts in the reacting vessel is high, the adsorption property, or affinity to the surface of the silver halide grains, is hindered due to the existence of the above-mentioned unnecessary substances as well as that dissolution of the silver halide grains and unevenness of grain size and composition accompanying thereto occurs so that monodispersed grains cannot be obtained. Therefore, the efficiency of spectral sensitizing dyes, sensitizers and stabilizers is extremely diminished. In addition, when the density of salts is high, drying property and storage stability of the light-sensitive material is reduced, requiring that the salts be removed.

Incidentally, in the above-mentioned production method, in a method which adds the aqueous halogen salt solution, there was a shortcoming that localization ions occur in the vicinity of an aqueous solution pouring port and, resulting in non-uniformity in the grain size or composition of the silver halide grains produced.

As a method which solves the above-mentioned non-uniformity of grains, recently, Japanese Patent Publication Open to Public Inspection (hereinafter, referred to as Japanese Patent O.P.I. Publication) Nos. 183417/1989 and 183654/1989 and WO Nos. 89/0683 and 89/06831 disclose technologies which do not supply silver salt and halogen salt in the form of an aqueous solution but supply it in the form of fine silver halide grains.

However, even in the case of the above-mentioned fine grains supplying method, unnecessary substances, described as above, remain in the system after the formation of the grains. Therefore, it is desirable to desalt and remove them.

Japanese Patent O.P.I. Publication Nos. 172816/1990 and 172817/1990 disclose technologies about the desairing method of the silver halide fine-grain emulsion. Aforesaid technologies are respectively one which desalt a fine grain silver halide emulsion while adding it to the reacting vessel and one which desalts the fine grain silver halide emulsion during adding to the emulsion in the reacting vessel. However, due to technologies described in the above-mentioned patents, aging fluctuation of grains occur in the mixing vessel, provided separately from the reacting vessel, because aforesaid fine grain emulsion is not desalted. Therefore, aforesaid fine grain emulsion solution could not be effectively stored so that it was necessary to precisely control the production schedule. Specifically, since Japanese Patent O.P.I. Publication No. 172817/1990 desalts a solution after a solution supplied it from the mixing vessel and a solution taken up from the reacting vessel or desalts the solution picked up from the reacting vessel, the desalting effect was not sufficient and remains of unnecessary ions were observed. Therefore, this technology does not employ a suitable desalting method.

SUMMARY OF THE INVENTION

A first object of the present invention is to provide a method of producing a silver halide photographic emulsion which grows silver halide grains wherein no dissolution of grains which occurs due to high salt density in the reacting vessel and there is no non-uniformity in grain size and halogen composition which follows the dissolution of the grains.

A second object of the present invention is to provide a method of producing a silver halide photographic emulsion wherein the efficiency of spectral sensitization or chemical sensitization is improved.

A third object of the present invention is to provide a silver halide photographic light-sensitive material containing the above-mentioned silver halide emulsion.

The objects of the present invention are achieved by the following items.

Item 1: A method of producing a silver halide photographic emulsion comprising steps of:

(a) forming silver halide fine-grain emulsion in a mixing vessel B separately provided from a reaction vessel A, (b) removing unnecessary ions contained in said silver halide fine-grain emulsion, (c) supplying the silver halide fine-grain emulsion to said reaction vessel A, (d) forming nucleation of a silver halide grain in said reaction vessel A, and (e) forming crystal growth of the silver halide grain in said reaction vessel A.

Item 2: A method of producing a silver halide photographic emulsion comprising steps of:

(a) forming silver halide fine-grain emulsion in a mixing vessel B separately provided from a reaction vessel A, (b) removing unnecessary ions contained in said silver halide fine-grain emulsion, (c) storing the silver halide fine-grain emulsion in a storing vessel C separately provided from said reaction vessel A and said mixing vessel B, (d) supplying the silver halide fine-grain emulsion to said reaction vessel A, (e) forming nucleation of a silver halide grain in said reaction vessel A, and (f) forming crystal growth of the silver halide grain in said reaction vessel A.

Item 3: The method of item 1, wherein said unnecessary ions removing step is carried out to the whole amount of said silver halide fine-grain emulsion.

Item 4: The method of item 2, wherein said unnecessary ions removing step is carried out to the whole amount of said silver halide fine-grain emulsion.

Item 5: The method of item 1, wherein said unnecessary ions removing step is carried out until a concentration of said unnecessary ions becomes not more than 10%.

Item 6: The method of item 3, wherein said unnecessary ions removing step is carried out until a concentration of said unnecessary ions becomes not more than 10%.

Item 7: The method of item 5, wherein said unnecessary ions removing step is carried out by an ultrafiltration method or an electrodialysis method.

Item 8: The method of item 6, wherein said unnecessary ions removing step is carried out by an ultrafiltration method or an electrodialysis method.

Item 9: A silver halide photographic light-sensitive material comprising a support, and provided thereon, at least one silver halide emulsion layer, wherein said silver halide emulsion is produced by a method comprising steps of:

(a) forming silver halide fine-grain emulsion in a mixing vessel B separately provided from a reaction vessel A, (b) removing unnecessary ions contained in said silver halide fine-grain emulsion, (c) supplying the silver halide fine-grain emulsion to said reaction vessel A, (d) forming nucleation of a silver halide grain in said reaction vessel A, and (e) forming crystal growth of the silver halide grain in said reaction vessel A.

EXPLANATION OF NUMERALS

Figure 1:
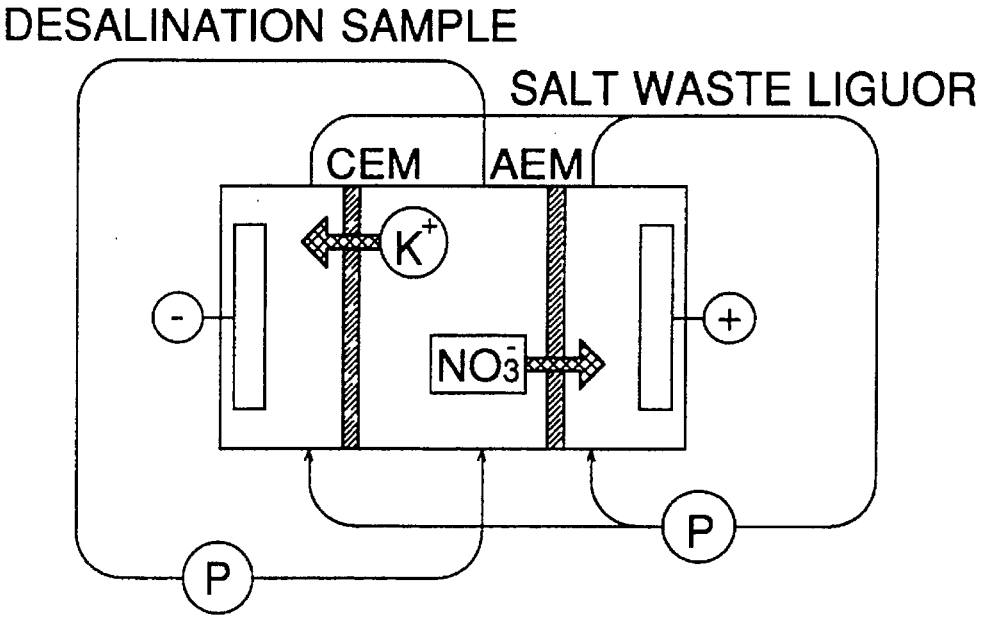
FIG. 1 is a schematic cross-sectional view of the electrodialysis.

1. Cation exchange membrane
2. Anion exchange membrane
3. Emulsion chamber
4. Salt effluent container
5. Electrode chamber
6. Cathode
7. Anode
8. Frame
9. Emulsion
10. Sale waster liquor
11. Electrode liquor
C. Circulation
41. Emulsion
42. Circulation pump
43. Ultrafiltration membrane
44. Pressure adjusting valve
45. Line
46. Salt effluent line

DETAILED DESCRIPTION OF THE INVENTION

Hereunder, the present invention will be explained in detail.

In the present invention, a fine-grain silver halide emulsion formed in a mixing vessel B is defined to be silver halide fine grains, prepared in advance, whose average grain size is 0.05 μm or less. Arbitrary halogen compositions are allowed for the fine-grain silver halide emulsion. The preferable ones are silver iodide, silver bromide or silver bromoiodide grains.

In the present invention, as a method which removes unnecessary ions contained in the fine grain silver halide emulsion, any conventional desalting method may be used. For example, a method, described in Japanese Patent O.P.I. Publication Nos. 4448/1972 and 46255/1974, in which the chilled silver halide emulsion is cut into a strip form or into an noodle form and washed by water, a ultrafiltration method using a semipermeable membrane described in Japanese Patent O.P.I. Publication Nos. 209823/1982, 43727/1984, 113137/1987, 172816/1990, 172817/1990 and 140946/1991, an ion-exchange applying method described in Japanese Patent O.P.I. Publication Nos. 219948/1986, 23035/1987, 40137/1988, 40039/1988, 22942/1992 and 63200/1994 and an electrodialysis method described in Japanese Patent Publication No. 3474/1958 may be used.

Of the above-mentioned methods, the preferable desalting method is one using an ultrafiltration method and an electrodialysis method.

FIG. 1 is an explanatory drawing showing the electrodialysis method.

With regard to an emulsion, silver halide is prepared, basically, by reacting silver nitrate with halogen salt such as sodium chloride, potassium bromide and a small amount of silver iodide. In these occasion, undesirable salts such as sodium nitrate, potassium nitrate, excessive sodium chloride or potassium bromide are also produced additionally. Therefore, it is necessary to remove them.

In FIG. 1, salts in an aqueous solution are dissociated into cations (for example, $K^+$) and anions (for example, $NO_3^-$). The "CEM" is a cation exchanging membrane, which only cations can pass. "AEM" is anions exchanging membrane, which only anions can pass. When an anode (–) is located outside the CEM and a cathode is located outside the AEM and a direct current is impressed, the cations in the solution are attracted by the anode to go to the anode through the CEM. The anions are attracted by the anode to go to the cathode through the AEM. The anion which was drawn to the anode side and the cation which was drawn to the cathode side respectively cannot pass through the AEM and the CEM. As a result, ions which once passed an exchanging membrane cannot return to the initial solution resulting in desalted solution.

Figure 3:
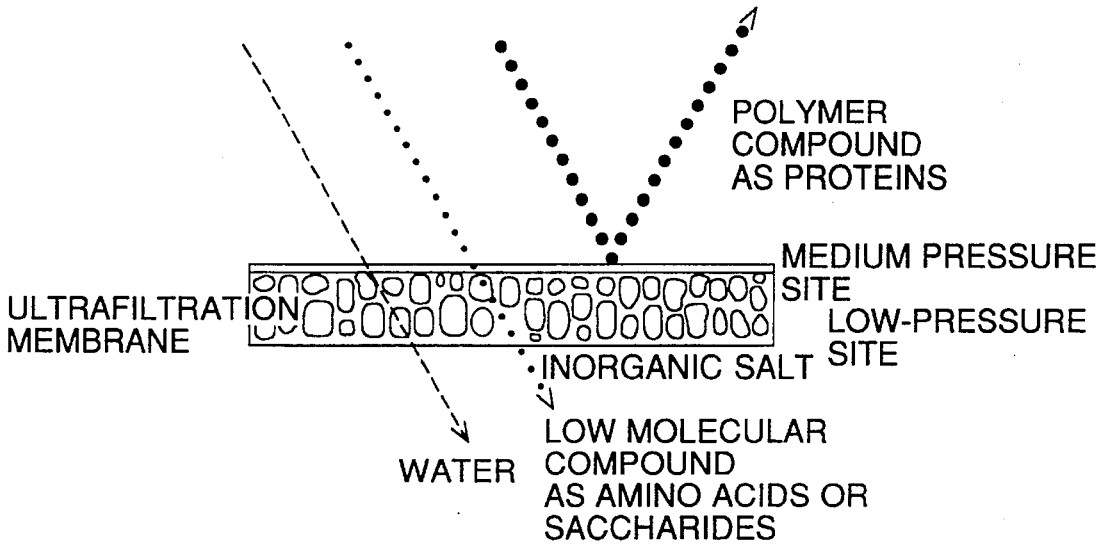
FIG. 3 is a schematic cross-sectional view of the ultrafiltration module.

FIG. 3 is a diagram explaining the ultrafiltration method.

The ultrafiltration method is a pressure filtration separation method by the use of a semipermeable membrane. In this method, relatively small molecules such as inorganic substances, sugars and amino acid pass through the membrane. However, relatively high molecular weight substances are difficult to pass.

Due to these phenomena, unnecessary ions in the fine grain silver halide emulsion of the present invention permeate and the fine grain silver halide emulsion is desalted successively.

In the present invention, as a protective colloid in the fine-grain silver halide emulsion, gelatin is ordinarily used. Practically, gelatin described in Item IX of Research Disclosure (RD) No. 17643 (December, 1978) can be used.

In the present invention, to supply the fine grain silver halide emulsion to a reaction vessel after desalting to 10% or less compared to the salt density of immediately after production, is to monitor the removal condition of ions by means of the conductivity of the emulsion while desalting, by means of the electrodialysis method, as a desalting method and to stop the electrodialysis when the conductivity becomes 10% or less and preferably 5% or less compared to the degree of the initial electrical conductivity for preparing fine-grain emulsion.

There is no limit to the type of silver halide grains supplied to the fine grain silver halide emulsion of the present invention. However, silver halide grains such as silver bromide, silver bromoiodide and silver bromochloroiodide wherein nuclei has been formed and their seed grains. Of these, seed grains desalted in advance may be used.

The silver halide emulsion of the present invention wherein the crystal growth has been completed by means of the fine grain supplying method may be desalted for removing unnecessary ions.

The silver halide photographic emulsion obtained by the method of the present invention can be used on various silver halide photographic light-sensitive material. Namely, in a silver halide photographic light-sensitive material comprising a support provided thereon with at least one light-sensitive silver halide emulsion layer on one side or on both sides, the silver halide photographic emulsion obtained by the present invention can be used in aforesaid silver halide emulsion layer. The silver halide photographic emulsion is usable with various silver halide photographic light-sensitive materials including commercial use photographic light-sensitive material for black-and-white and color use, cinematic photographic light-sensitive material for black-and-white and color use and industrial photographic light-sensitive materials such as for X-ray use and graphic art use.

EXAMPLES

Hereunder, the present invention will be explained further in detail referring to the examples.

Example 1

<Preparation of Seed emulsion TEM-1>

In an aqueous 2 wt % gelatin solution whose temperature was raised to 40° C., an aqueous 4N silver nitrate solution and an aqueous 4N potassium bromide solution were mixed by means of a controlled double jet method so that a silver halide emulsion of an average grain size of 0.3 μm was prepared. By means of an electrodialysis method shown in FIG. 1, a seed emulsion TEM-1 was obtained.

<Preparation of Fine grain emulsion B-1>

In an aqueous 5 wt % gelatin solution whose temperature was raised to 30° C., an aqueous 3.5N silver nitrate solution and an aqueous 3.5N potassium bromide solution were mixed by means of a controlled double-jet method so that a silver halide emulsion B-0 was prepared. As a result of observing these grains through an electron microscope, revealed a mono-dispersed grain whose average grain size was 0.05 μm and whose variation coefficient of 10%.

The resulting fine-grain emulsion B-0 was subjected to desalting by the use of the electrodialysis method as shown in FIG. 1. For desalting, the following solution was used.

| | |
|---|---|
| (A) The above-mentioned silver halide fine-grain emulsion B-0 | 1000 cc |
| (B) An aqueous 0.05 N $KNO_3$ solution | |
| (C) An aqueous 0.3 N $KNO_3$ solution | |

Figure 2:
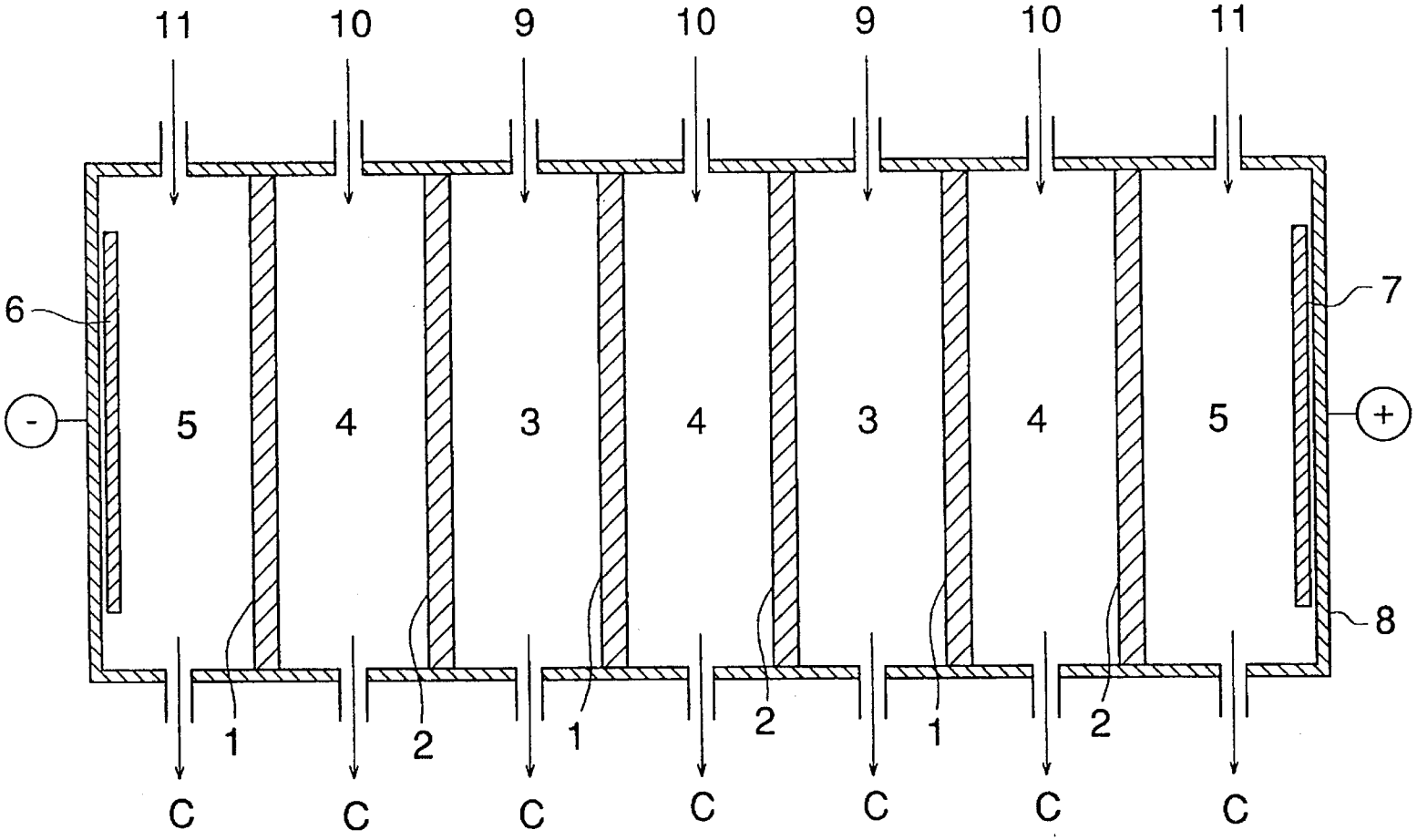
FIG. 2 is a schematic cross-sectional view of the electrodialysis apparatus according to the present invention.

An electrodialysis apparatus used in the example will be explained in FIG. 2. In FIG. 2, an anion exchanging membrane 1 and a cation exchanging membrane 2 are placed alternately. The apparatus was divided into an emulsion chamber 3 which circulates an emulsion, a salt effluent container 4 which keeps salt removed and an electrode port 5. At both sides, electrodes are provided.

The above-mentioned solution (A) was put in the emulsion chamber 3, the solution (B) was inserted to the salt effluent solution chamber 4 and the solution (C) was put in the electrode chamber 5. Each solution was circulated while at a maintained temperature of 35° C. By impressing a direct current, ions in the emulsion were moved to the salt effluent solution chamber through an ion exchanging membrane to remove any unnecessary ion. The ion removal performance was evaluated by monitoring the decrease of the conductivity of the emulsion. When the degree of conductivity reached 5% or less of the initial conductivity, the electrodialysis was stopped to obtain the fine-grain emulsion B-1 of the present invention.

<Preparation of a growed emulsion EM-1 of the present invention>

Next, in a silver halide ripening vessel wherein a seed emulsion TEM-1 was put in advance, the fine grain emulsion B-1 was added. The mixture in the ripening vessel was stirred with a propeller fan, and then, with the seed emulsion, the mixture was ripened so that a silver bromide emulsion EM-1 of the present invention having an average grain size of 0.8 μm was obtained. Incidentally, the conductivity of EM-1 was 2 mS/cm.

<Preparation of the seed emulsion TEM-2>

In an aqueous 2.5 w % gelatin solution whose temperature was raised to 40° C., an aqueous 4N silver nitrate solution and an aqueous 4N potassium bromide solution were mixed by means of a controlled double-jet method to prepare a silver halide seed emulsion whose average grain size was 0.3 μm. Salts were removed by an ultrafiltration method for obtaining TEM-2.

<Preparation of a fine grain emulsion B-2 of the present invention>

Figure 4:
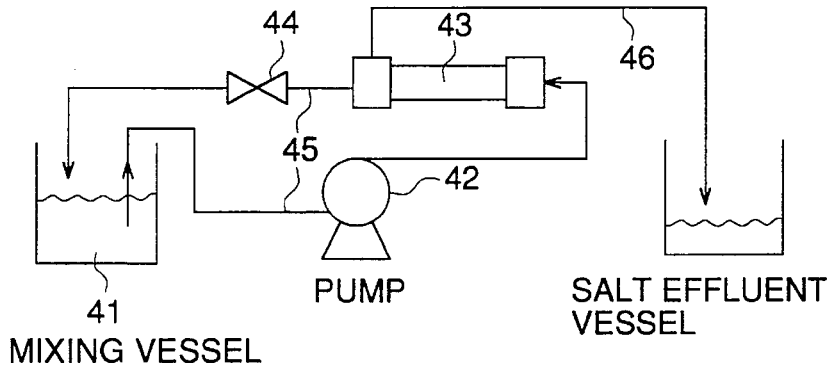
FIG. 4 is an apparatus example according to the present invention.

An apparatus used for the example will be explained referring to FIG. 4. An emulsion 41 was circulated inside an ultrafiltration module 43, by means of a circulation pump 42, through an ultrafiltration membrane explained in FIG. 3. By means of a pressure-adjusting valve 44, pressure inside line 45 was adjusted. From the emulsion which passed the ultrafiltration module 3, water and a part of water-soluble ions were removed through a salt effluent line 46. Removal performance of ions was evaluated by monitoring the conductivity of the emulsion.

Undesalted fine-grain B-0 was subjected to the above-mentioned ultrafiltration. When the conductivity reached 5% or less of the initial conductivity, the filtration was stopped to obtain the fine grain emulsion B-2 of the present invention.

<Preparation of a growed emulsion EM-2 of the present invention>

In a silver halide emulsion ripening vessel wherein a seed emulsion TEM-2 was inserted in advance, a fine-grain emulsion B-2 was added. The mixture in aforesaid ripening vessel was stirred by a propeller fan and the seed emulsion was ripened so that a silver halide emulsion EM-2 whose average grain size was 0.8 μm was obtained.

<Preparation of an emulsion EM-0 for comparative>

By the use of a seed emulsion TEM-1 in the same manner as above and a fine grain emulsion B-0 which was not subjected to desalting, an emulsion EM-0 for comparative was prepared. The resulting emulsion was desalted by the electrodialysis method to the same conductivity as in the above-mentioned EM-1 in preparation an emulsion EM-0 for comparative.

After the resulting emulsions EM-1, EM-2 and EM-0 were regulated for chemical ripening condition, at 55° C., 150 mg of sodium salt of anhydro-5,5'-dichloro-9-ethyl-3,3'-di-(4-sulfobutyl) -thiacarbocyanine was added as a spectral sensitizing dye per mol of silver halide. Next, as chemical sensitizers, ammonium thiocyanate salt, chloro aurate and sodium thiosulfate were added. Next, the resulting mixture was subjected to chemical sensitization to obtains the maximum sensitivity, and then, at the finish of ripening, an appropriate amount of 4-hydroxy-6-methyl-1,3,3a,7-tetrazaindene was added as a stabilizer.

The following additives were added per mol of emulsion prepared in the above-mentioned manner so that a coating solution was prepared.

| | |
|---|---|
| Stylene-maleic acid anhydride copolymer | 800 mg |
| Sodium salt of 2-mercaptobenzimidazole-5-sulfonic acid | 0.5 mg |

As a protective layer, a coating solution containing the following additives per 1 liter was prepared.

| | |
|---|---|
| Gelatin | 68 g |
| Sodium salt of 2,4-dichloro-6-hydroxy-1,3,5-triazine (an aqueous 2% solution) | 12 ml |
| Formaline (35% solution) | 2 ml |
| Glyoxal (40% solution) | 2 ml |

Coating solutions for an emulsion layer and a protective layer prepared in the above-mentioned manner respectively were coated on one side of a polyethylene terephthalate base provided with subbing concurrently. Added amount of silver in an emulsion layer was 2 g per 1 $m^2$, added amount of gelatin in the emulsion layer was 1.8 g and the added amount of gelatin in the emulsion protective layer was 0.8 g.

<Sensitometry>

After the resulting sample was subjected to wedge exposure, through a DG filter to a tungsten tube, whose color temperature was 5000° K., through a DG filter, it was then processed with an automatic processing machine was SRX-503 containing a developing solution XD-SR and a fixing solution XF-SR (all of them were produced by Konica) for 30 seconds at 35° C. After processing, its sensitivity was obtained from the inverse of the exposure energy necessary to obtain density of fogging+0.1. Table 1 shows the relative sensitivity, with the sensitivity of sample No. 1 being defined as 100. γ was an inclination in the characteristics curve at a line portion.

TABLE 1

| Kind of emulsion | Fogging | Sensitivity | γ | Remarks |
|---|---|---|---|---|
| EM-1 | 0.07 | 100 | 1.7 | Invention |
| EM-2 | 0.08 | 99 | 1.8 | Invention |
| EM-0 | 0.12 | 86 | 1.4 | Comparative |

It should be understood from Table 1 that, compared to the comparative sample, the samples of the present invention show lower fogging property, higher sensitivity and high γ.

Example 2

In the same manner as in B-1 of Example 1, an emulsion was prepared, and also in the same manner, it was subjected to electrodialysis. When electric conductivity became 50%, 15%, 10% and 8% of the initial conductivity, electrodialysis was stopped so that fine grain emulsions B-3, B-4, B-5 and B-6 were obtained respectively. In addition, in the same manner as in B-2, an emulsion was prepared, which was subjected to ultrafiltration. In the same manner as above, when electric conductivity became 50%, 15%, 10% and 8% of the initial conductivity, ultrafiltration was stopped so that fine-grain emulsions B-7, B-8, B-9 and B-10 were obtained respectively.

<Comparative test>

The resulting fine-grain emulsions B-3, B-4, B-5 and B-6, the undesalted fine grain emulsion B-0 used in Example 1 and the desalted fine grain emulsion B-1 were stored at 35° C., for 5 hours under the same conditions. The fluctuation of the silver halide grain size through over time was traced. In the same manner, fluctuation of each silver halide grain size of B-0, B-2, B-7, B-8, B-9 and B-10 was traced.

Figure 5:
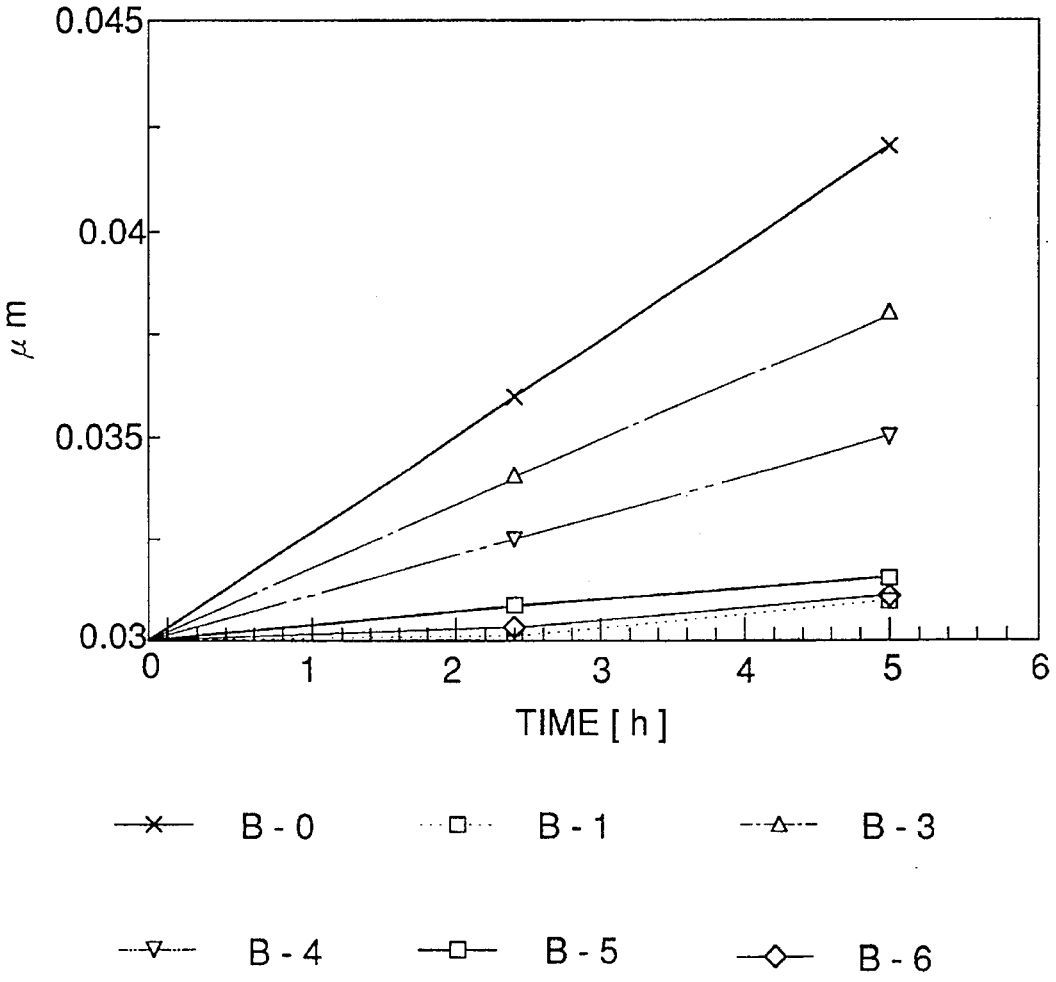
FIG. 5 and FIG. 6 are graphs of the grain size fluctuation against the emulsion storing time.
Figure 6:
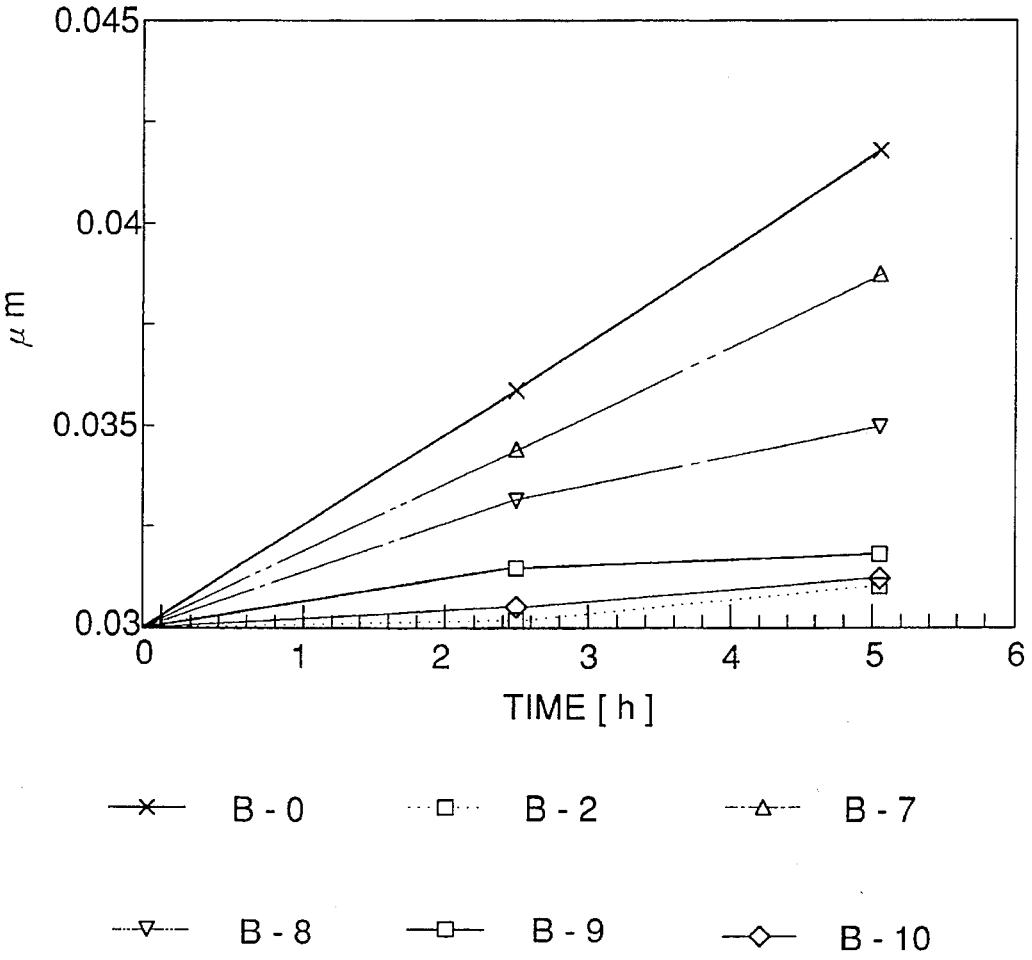

FIGS. 5 and 6 show the results. As is apparent from FIGS. 5 and 6, the higher the salt removal ratio of emulsion (for example, B-1), the smaller the grain size fluctuation (a vertical axis) against storing time (a horizontal axis) so that the more stable they are (see FIGS. 5 and 6).

Example 4

By the use of fine grain emulsions B-3, B-4, B-5, B-6, B-7, B-8, B-9 and B-10 obtained in Example 2, a grain was grown in the same manner as in EM-1 of Example 1 and then the grain was not desalted, emulsions EM-3, EM-4, EM-5, EM-6, EM-7, EM-8, EM-9 and EM-10 were obtained.

Next, 200 mg of anhydro-5,5'-diphenyl-9-ethyl-3,3'-di-(3-sulfopropyl)-oxacarbocuanine hydroxide as a spectral sensitizing dye was added to EM-1 prepared in Example 1. The mixture was stirred for 30 minutes at 50° C. so that the mixture was adsorbed completely, and then, the resulting mixture was subjected to centrifugal separation and then, the amount of dye adsorbed was assumed.

The following Table 2 shows these results. Incidentally, the adsorbed dye amount is defined to be a relative value when that in an emulsion EM-1 is defined to be 1.

TABLE 2

| Kind of emulsion | Salt removal (%) | Relative amount of a dye adsorbed | Kind of emulsion | Salt removal (%) | Relative amount of a dye adsorbed |
|---|---|---|---|---|---|
| EM-1 | 5 | 1 | EM-2 | 5 | 1 |
| EM-6 | 8 | 0.92 | EM-10 | 8 | 0.94 |
| EM-5 | 10 | 0.86 | EM-9 | 10 | 0.82 |
| EM-4 | 15 | 0.58 | EM-8 | 15 | 0.60 |
| EM-3 | 50 | 0.26 | EM-7 | 50 | 0.28 |

From the adsorbed dye amount in the above-mentioned Table 2, it can be said that, if the fine grain emulsion is desalted up to at least 10% of the initial conductivity, adsorption of dye necessary to spectrally sensitize can be obtained without a desalting step after being grown. Incidentally, if the fine-grain emulsion is desalted up to 5% of the initial conductivity, spectral sensitivity efficiency can be further improved.

What is claimed is:

1. A method of producing a silver halide photographic emulsion comprising (a) preparation of a crystal growth process emulsion containing a nucleus of a silver halide grain in a reaction vessel;

(b) mixing at least a silver salt solution and a halide solution so that a fine grain emulsion containing fine grains of silver halide and unnecessary ions is formed in a mixing vessel;

(c) removing said unnecessary ions from said fine grain emulsion;

(d) thereafter introducing said fine grain emulsion into said crystal growth process emulsion in the vessel;

(e) conducting crystal growth in said crystal growth process emulsion so that said fine grains grow said nucleus into a crystal of said silver halide grain, whereby said silver halide photographic emulsion is formed.

2. The method of claim 1, wherein said fine-grain silver halide emulsion is desalted by a desalting method until a salt concentration of said fine-grain silver halide emulsion becomes not more than 10%.

3. The method of claim 2, wherein said desalting method is an ultrafiltration method or an electrodialysis method.

4. The method of claim 1 wherein (c) is carried out in said mixing vessel.

5. A method of producing a silver halide photographic emulsion comprising (a) preparation of a crystal growth process emulsion containing a nucleus of a silver halide grain in a reaction vessel;

(b) mixing at least a silver salt solution and a halide solution so that a fine grain emulsion containing fine grains of silver halide and unnecessary ions is formed in a mixing vessel;

(c) removing said unnecessary ions from said fine grain emulsion;

(d) thereafter storing said fine grain emulsion in a storing container;

(e) introducing said fine grain emulsion into said crystal growth process emulsion from said storing container into said reaction vessel;

(f) conducting crystal growth in said crystal growth process emulsion so that said fine-grains grow said nucleus into a crystal of said silver halide grain, whereby said silver halide photographic emulsion is formed.

6. The method of claim 5, wherein said fine-grain silver halide emulsion is desalted by a desalting method until a salt concentration of said fine-grain silver halide emulsion becomes not more than 10%.

7. The method of claim 6, wherein said desalting method is an ultrafiltration method or an electrodialysis method.

8. The method of claim 5 wherein (c) is carried out in said mixing vessel.

* * * * *